US011017701B2

(12) United States Patent
Sawahata

(10) Patent No.: US 11,017,701 B2
(45) Date of Patent: May 25, 2021

(54) CORRECTION DATA GENERATING DEVICE, COMPUTER PROGRAM, METHOD FOR GENERATING CORRECTION DATA, AND METHOD FOR PRODUCING DISPLAY PANEL

(71) Applicant: SAKAI DISPLAY PRODUCTS CORPORATION, Sakai (JP)

(72) Inventor: Junichi Sawahata, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 0 days.

(21) Appl. No.: 16/556,064

(22) Filed: Aug. 29, 2019

(65) Prior Publication Data

US 2020/0090565 A1 Mar. 19, 2020

(30) Foreign Application Priority Data

Sep. 14, 2018 (JP) ..... JP2018-172646

(51) Int. Cl.
*G09G 5/10* (2006.01)
*G09G 3/00* (2006.01)
*G09G 3/36* (2006.01)

(52) U.S. Cl.
CPC ..... *G09G 3/006* (2013.01); *G09G 3/3648* (2013.01); *G09G 2310/0275* (2013.01); *G09G 2320/0233* (2013.01); *G09G 2320/0285* (2013.01); *G09G 2320/0693* (2013.01)

(58) Field of Classification Search
CPC ... G09G 2310/0275; G09G 2320/0233; G09G 2320/0285; G09G 2320/0693; G09G 2330/12; G09G 3/006; G09G 3/3648
See application file for complete search history.

(56) References Cited

U.S. PATENT DOCUMENTS

2012/0113301 A1* 5/2012 Ueda ..... H04N 5/23212 348/246
2013/0002910 A1* 1/2013 Sambonsugi ..... H04N 5/367 348/246
2013/0342558 A1 12/2013 Sasaki

FOREIGN PATENT DOCUMENTS

WO 2012/133890 A1 10/2012

* cited by examiner

*Primary Examiner* — Insa Sadio
(74) *Attorney, Agent, or Firm* — ScienBiziP, P.C.

(57) ABSTRACT

A correction data generating device is a device generating correction data for correcting input grayscale level vs. luminance characteristics of a plurality of pixels included in a display region of a display panel, and includes a display controller supplying each of the plurality of pixels with display signal voltages corresponding to two or more grayscale levels; an acquisition portion acquiring two or more luminances of each of the plurality of pixels supplied with the display signal voltages respectively corresponding to the two or more grayscale levels; a specification portion specifying, among the plurality of pixels, at least one abnormal pixel, the input grayscale level vs. luminance characteristic of which needs to be corrected and also specifying at least one correction target grayscale level including a grayscale level that needs to be corrected, based on the two or more luminances of each of the plurality of pixels acquired by the acquisition portion; and a generation portion generating correction data based on the at least one abnormal pixel and the at least one correction target grayscale level specified by the specification portion.

16 Claims, 12 Drawing Sheets

BEFORE CORRECTION OF LUMINANCE NON-UNIFORMITY

AFTER CORRECTION OF LUMINANCE NON-UNIFORMITY

BEFORE CORRECTION OF LUMINANCE NON-UNIFORMITY

AFTER CORRECTION OF LUMINANCE NON-UNIFORMITY

CORRECTION DATA GENERATING DEVICE, COMPUTER PROGRAM, METHOD FOR GENERATING CORRECTION DATA, AND METHOD FOR PRODUCING DISPLAY PANEL

BACKGROUND

Technical Field

The present invention relates to a correction data generating device generating correction data for correcting input grayscale level vs. luminance characteristics of a plurality of pixels included in a display region of a display panel, a computer program realizing the correction data generating device, a method for generating the correction data, and a method for producing a display panel using the same.

Description of the Related Art

In a display apparatus such as a liquid crystal display (LCD), an organic EL display (OLED) or the like, there is a case where even when a voltage corresponding to an intermediate grayscale is applied to all the pixels in a display region of a display panel, the luminance of one of the pixels is higher (larger) or lower (smaller) than the luminance of the other pixels for various reasons relating to the production process, and as a result, a luminance non-uniformity that a bright area or a dark area appears in the display region is generated. Such a "luminance non-uniformity" is generated because there is a pixel having an input grayscale level vs. luminance characteristic (also referred to as a "γ characteristic") different from a target (or set) γ characteristic. In this specification, the "luminance non-uniformity" refers to a non-uniformity caused by the presence of such a pixel having a γ characteristic shifted from the target γ characteristic. Such a shift of the luminance of a pixel from a predetermined luminance is referred to as "luminance abnormality".

In such a situation, a correction system by which an image displayed on a display panel is captured by an image capturing device and correction data corresponding to each of the pixels in the display panel is generated based on the image capturing results has been disclosed (see WO2012/133890).

SUMMARY

With reference to FIG. 10, it will be described that a luminance non-uniformity is generated by the presence of a pixel having a grayscale level vs. luminance characteristic different from a target grayscale level vs. luminance characteristic (γ characteristic; e.g., γ=2.2) (such a pixel will be referred to as an "abnormal pixel"). FIG. 10 shows an example of grayscale level vs. luminance characteristic of a display panel, and shows a grayscale level vs. luminance characteristic of a normal pixel (solid line) and a grayscale level vs. luminance characteristic of an abnormal pixel (dashed line). In the case where both a normal pixel(s) and an abnormal pixel(s) are present in a region that displays a certain grayscale and the difference in the luminance between the normal pixel(s) and the abnormal pixel(s) exceeds a tolerance, the difference is recognized as a luminance non-uniformity.

In FIG. 10, the horizontal axis represents the grayscale, and the vertical axis represents the luminance. The grayscale includes, for example, 256 grayscale levels from 0 (black) to 255 (white). The grayscale level vs. luminance characteristic of the normal pixel represented by the solid line in the figure is the target grayscale level vs. luminance characteristic and is known, whereas the grayscale level vs. luminance characteristic of the abnormal pixel represented by the dashed line is unknown and may change depending on the pixel.

Now, with reference to FIG. 11, it will be described how a conventional correction system corrects the luminance non-uniformity. FIG. 11 shows an example of conventional method for correcting the luminance non-uniformity, and shows the grayscale level vs. luminance characteristics corresponding to the part represented by reference sign A in FIG. 10, which are obtained from an image (captured image) obtained by image capturing performed on an image displayed on the display panel. In the captured image, a part corresponding to the normal pixel on the display panel may be referred to as a "normal position", and a part corresponding to the abnormal pixel on the display panel may be referred to as an "abnormal position". For the sake of simplicity, terms "normal pixel" and "abnormal pixel" may be used for the captured image. In FIG. 11, the solid line represents the grayscale level vs. luminance characteristic of the normal position (known), and the dashed line represents the grayscale level vs. luminance characteristic of the abnormal position (unknown). In order to correct the luminance non-uniformity, it is needed to convert the luminance difference between the luminance of the normal position and the luminance of the abnormal position into a grayscale.

In FIG. 11, the luminance at a grayscale level as a correction target, on the grayscale level vs. luminance characteristic of the abnormal position is represented by reference sign P1, and the luminance at the grayscale level as the correction target, on the grayscale level vs. luminance characteristic of the normal position is represented by reference sign P3. The luminance difference between P1 and P3 is the cause of the luminance non-uniformity at the grayscale level as the correction target.

A luminance represented by reference sign P2 is on the grayscale level vs. luminance characteristic of the normal position and is equal to the luminance P1. The grayscale level vs. luminance characteristic of the abnormal position is unknown, and therefore, is assumed to be substantially the same as the grayscale level vs. luminance characteristic of the normal position. With such an assumption, a grayscale amount ΔG required for the correction (grayscale correction amount) is a grayscale level difference corresponding to the luminance difference between the luminance P2 and the luminance P3 on the grayscale level vs. luminance characteristic of the normal position. Namely, when the grayscale level is decreased by the grayscale correction amount ΔG from the grayscale level as the correction target, the luminance should go from P1 to P3. However, in the case where the grayscale level vs. luminance characteristic of the abnormal position is shifted relatively largely from the grayscale level vs. luminance characteristic of the normal position, even when the grayscale level is corrected by ΔG from the grayscale level as the correction target, the obtained luminance is a luminance represented by reference sign P4, which does not match P3. The difference between P4 and P3 is a luminance difference, and thus the luminance non-uniformity remains.

FIG. 12 is a schematic view showing an example of state of the display panel obtained by the correction made by the conventional correction system. As shown in the left view of FIG. 12, before the correction of the luminance non-uniformity, a luminance non-uniformity (region represented with a pattern for the sake of convenience) is generated in the vicinity of the center of the display panel. The luminance non-uniformity may be darker or brighter than the region around the luminance non-uniformity. As shown in the right view of FIG. 12, even after the correction of the luminance non-uniformity, a luminance non-uniformity (region represented with a pattern for the sake of convenience) remains in the vicinity of the center of the display panel. As can be seen, in the case where the grayscale level vs. luminance characteristic of the abnormal position is shifted largely from the grayscale level vs. luminance characteristic of the normal position, the luminance non-uniformity remains even after the correction by the conventional correction system. Therefore, generation of correction data needs to be repeated a plurality of times.

The present invention, made in light of such a situation, has an object, of providing a correction data generating device, a computer program, a method for generating correction data and a method for producing a display panel capable of correcting the luminance non-uniformity effectively even in the case where the luminance non-uniformity is large.

A correction data generating device according to an embodiment of the present invention is a device generating correction data for correcting input grayscale level vs. luminance characteristics of a plurality of pixels included in a display region of a display panel. The correction data generating device includes a display controller supplying each of the plurality of pixels with display signal voltages corresponding to two or more grayscale levels; an acquisition portion acquiring two or more luminances of each of the plurality of pixels supplied with the display signal voltages respectively corresponding to the two or more grayscale levels; a specification portion specifying, among the plurality of pixels, at least one abnormal pixel, the input grayscale level vs. luminance characteristic of which needs to be corrected and also specifying at least one correction target grayscale level including a grayscale level that needs to be corrected, based on the two or more luminances of each of the plurality of pixels acquired by the acquisition portion; and a generation portion generating correction data based on the at least one abnormal pixel and the at least one correction target grayscale level specified by the specification portion.

A computer program according to an embodiment of the present invention is a computer program causing a computer to generate correction data for correcting input grayscale level vs. luminance characteristics of a plurality of pixels included in a display region of a display panel. The computer program causes the computer to execute a process of supplying each of the plurality of pixels with display signal voltages corresponding to two or more grayscale levels; a process of acquiring two or more luminances of each of the plurality of pixels supplied with the display signal voltages respectively corresponding to the two or more grayscale levels; a process of specifying, among the plurality of pixels, at least one abnormal pixel, the input grayscale level vs. luminance characteristic of which needs to be corrected and also specifying at least one correction target grayscale level including a grayscale level that needs to be corrected, based on the two or more luminances of each of the plurality of pixels; and a process of generating correction data based on the at least one abnormal pixel and the at least one correction target grayscale level.

A correction data generating method according to an embodiment of the present invention a method for generating correction data for correcting input grayscale level vs. luminance characteristics of a plurality of pixels included in a display region of a display panel. The correction data generating method includes step (a) of supplying each of the plurality of pixels with display signal voltages corresponding to two or more grayscale levels; step (b) of acquiring two or more luminances of each of the plurality of pixels supplied with the display signal voltages respectively corresponding to the two or more grayscale levels; step (c) of specifying, among the plurality of pixels, at least one abnormal pixel, the input grayscale level vs. luminance characteristic of which needs to be corrected and also specifying at least one correction target grayscale level including a grayscale level that needs to be corrected, based on the two or more luminances, acquired in the step (b), of each of the plurality of pixels; and step (d) of generating correction data based on the at least one abnormal pixel and the at least one correction target grayscale level specified in the step (c).

A method for producing a display panel according to an embodiment of the present invention includes a step of creating, based on the correction data generated by the above-described method, a lookup table based on which an input grayscale level vs. luminance characteristic is determined and writing the lookup table on a storage device included in the display panel.

Embodiments of the present invention provide effective correction of a luminance non-uniformity even in the case where the luminance non-uniformity is large.

DETAILED DESCRIPTION

Hereinafter, embodiments of the present invention will be described with reference to the drawings. The embodiments of the present invention are not limited to the embodiments described below.

Figure 1:
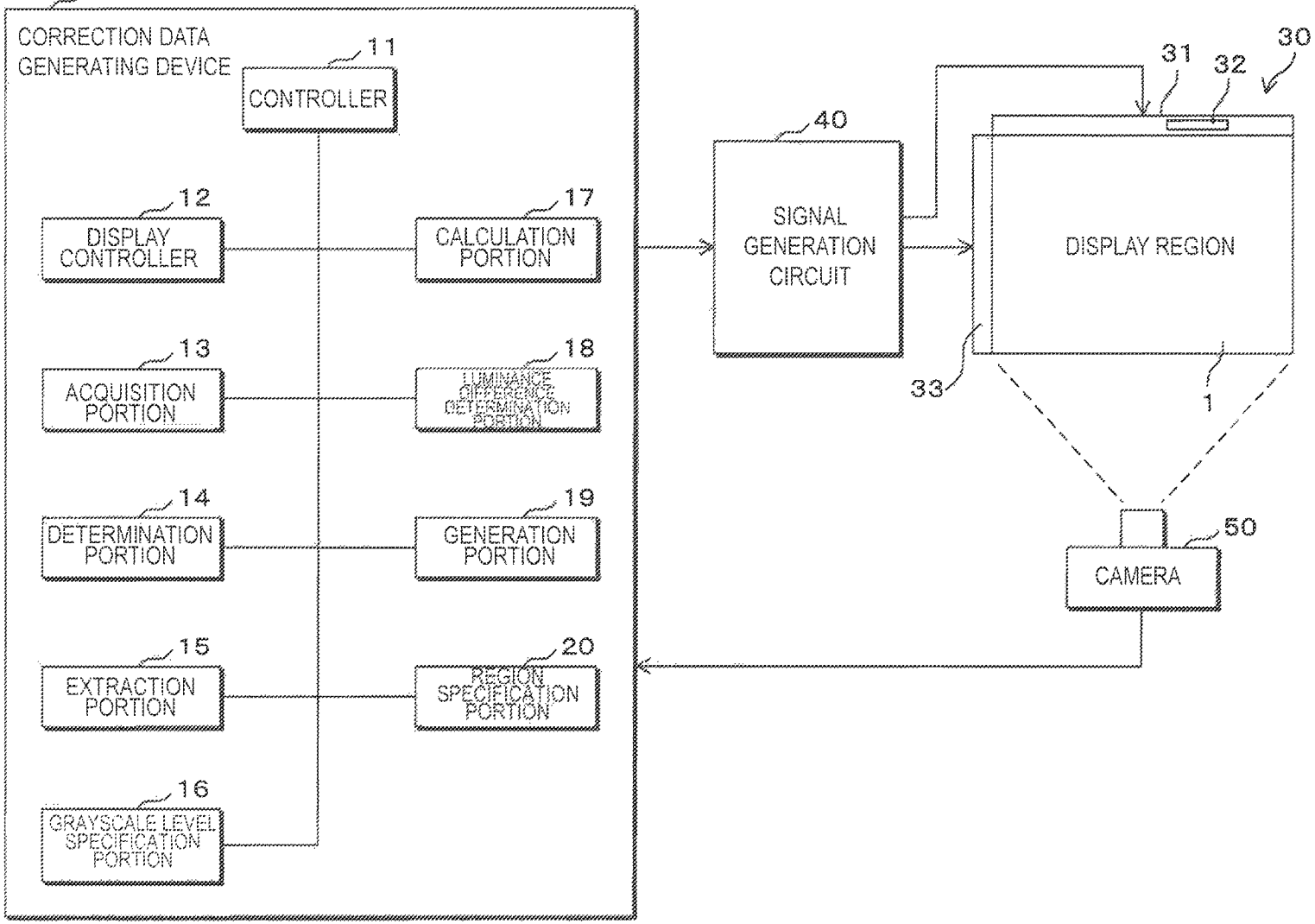
FIG. 1 is a block diagram showing an example of structure of a correction data generating device according to an embodiment.

FIG. 1 is a block diagram showing an example of structure of a correction data generating device 10 according to an embodiment of the present invention. As shown in FIG. 1, the correction data generating device 10 is connected with a display panel 30 via a signal generation circuit 40. The signal generation circuit 40 outputs, for example, image data, a control signal for displaying an image, and the like to the display panel 30 via a source substrate 31 and a gate substrate 33 based on an instruction output by the correction data generating device 10.

The correction data generating device 10 generates correction data for correcting input grayscale level vs. luminance characteristics of a plurality of pixels included in a display region 1 of the display panel 30. The correction data generating device 10 includes a display controller 12 supplying each of the plurality of pixels with display signal voltages corresponding to two or more grayscale levels, an acquisition portion 13 acquiring two or more luminances of each of the pixels supplied with the display signal voltages respectively corresponding to the two or more grayscale levels, a specification portion specifying, among the plurality of pixels, at least one abnormal pixel, the input grayscale level vs. luminance characteristic of which needs to be corrected and also specifying at least one correction target grayscale level including a grayscale level that needs to be corrected, based on the two or more luminances of each of the plurality of pixels acquired by the acquisition portion 13, and a generation portion 19 generating correction data based on the at least one abnormal pixel and the at least one correction target grayscale level specified by the specification portion.

The display panel 30 includes a display region 1 (display screen). The source substrate 31 is provided on a source input side having a source driver (not shown) mounted thereon, and the gate substrate 33 is provided on a gate input side having a gate driver (not shown) mounted thereon. The display panel 30 is, for example, a TFT liquid crystal display panel including a thin film transistor (hereinafter, referred to as a "TFT") in each of the plurality of pixels. The signal generation circuit 40 supplies display signal voltages corresponding to the grayscale levels to be displayed by each pixel to a plurality of source bus lines (display signal lines) via the source driver (not shown). The signal generation circuit 40 sequentially supplies scanning signal voltages selecting a pixel to be supplied with the display signal voltage to a plurality of gate bus lines (scanning signal lines) via the gate driver (not shown). An operation of supplying a certain pixel with a display signal voltage corresponding to a certain grayscale level may be expressed as that "the certain pixel displays (or exhibits) the certain grayscale level". A memory 32 is mounted on the source substrate 31. The memory 32 stores luminance shift correction values of each pixel included in the display region 1. Namely, the memory 32 is like a correction table that allocates addresses in correspondence with the pixels included in the display region 1 and stores the luminance shift correction values of a pixel corresponding to each of the addresses.

A camera 50 has a function of an image capturing portion, and captures an image (more specifically, an image for inspection) displayed on the display region 1 of the display panel 30 and outputs a captured image (captured image data) obtained by the capturing to the correction data generating device 10.

The correction data generating device 10 includes, for example, a controller 11 controlling the entirety of the device, the display controller 12, the acquisition portion 13, a determination portion 14, an extraction portion 15, a grayscale level specification portion 16, a calculation portion 17, a luminance difference determination portion 18, the generation portion 19, a region specification portion 20, and the like.

The display controller 12 performs control so as to sequentially display images respectively at arbitrary grayscale levels on the display region 1. The display signal voltage supplied by the display controller 12 may, for example, correspond to all of grayscale levels except for a lowest grayscale level (i.e., black) among grayscale levels of the input grayscale level vs. luminance characteristics of the plurality of pixels (e.g., among 256 grayscale levels of 0 to 255) or correspond to three or more grayscale levels that are every predetermined number of grayscale levels (e.g., every other grayscale levels). For example, in the case where the grayscale levels include 256 levels of 0 (black) to 255 (white), 256 images of grayscale levels of 0, 1, 2, . . . 255 may be sequentially displayed, or images of grayscale levels such as grayscale levels of 0, 2, 4, . . . 255 may be displayed with some grayscale levels being deleted. Alternatively, as the grayscale levels become larger (higher), the degree at which the grayscale levels are deleted may be increased. The image may be an image for inspection in which all the pixels exhibit the same grayscale level. In this embodiment, images of grayscale levels N (e.g., N is 0 to 255) are sequentially displayed. The grayscale levels of the images to be displayed, the number of the grayscale levels, and the order of the grayscale levels may be appropriately determined.

The acquisition portion 13 acquires two or more luminances of each of the plurality of pixels supplied by the display controller 12 with the display signal voltages respectively corresponding to the two or more grayscale levels. For example, each time an image of a different grayscale level is displayed on the display region 1, the acquisition portion 13 acquires, from the camera 50, a captured image (captured image data) obtained by the image capturing performed on the image by the camera 50. For the sake of simplicity, a portion of the captured image that corresponds to a pixel of the display panel may be referred to as a "pixel".

Based on the two or more luminances of each of the plurality of pixels acquired by the acquisition portion 13, the specification portion specifies, among the plurality of pixels, at least one abnormal pixel, the input grayscale level vs. luminance characteristic of which needs be corrected, and also specifies at least one correction target grayscale level including a grayscale level that needs to be corrected. The specification portion includes, for example, the grayscale level specification portion 16 and the region specification portion 20 described below.

The generation portion 19 generates correction data based on the at least one abnormal pixel and the at least one correction target grayscale level specified by the specification portion.

Upon receipt of the at least one correction target grayscale level specified by the specification portion, the display controller 12 may further supply each of the plurality of pixels with display signal voltages corresponding to two or more grayscale levels including the at least one correction target grayscale level. Then, the acquisition portion 13 and the specification portion perform the above-described processes again. Such a series of processes may be repeated a plurality of times. The at least one abnormal pixel and the at least one correction target grayscale level specified by the specification portion are updated each time the series of processes are repeated. For example, the display signal voltages first supplied by the display controller 12 to the pixels may correspond to grayscale levels with a roughly set interval, and the display signal voltages supplied thereafter may correspond to the specified correction target grayscale level and grayscale levels around the specified correction target grayscale level with a finely set interval. For example, the display controller 12 may supply each of the plurality of pixels with display signal voltages corresponding to three or more grayscale levels that are every predetermined first number of grayscale levels. Upon receipt of the at least one correction target grayscale level that is specified by the specification portion upon receipt of such display signal voltages, the display controller 12 may further supply each of the plurality of pixels with display signal voltages corresponding to grayscale levels including three or more grayscale levels that include the at least one correction target grayscale level and are every predetermined second number of grayscale levels, the predetermined second number being smaller than the predetermined first number.

The specification portion further includes, for example, a luminance shift evaluation portion evaluating a shift from a luminance on a predetermined input grayscale level vs. luminance characteristic, regarding each of the two or more luminances, acquired by the acquisition portion 13, of each of the plurality of pixels. The luminance shift evaluation portion includes, for example, the determination portion 14, the extraction portion 15, the calculation portion 17 and the luminance difference determination portion 18 described below. The predetermined input grayscale level vs. luminance characteristic is, for example, a target input, grayscale level vs. luminance characteristic ($\gamma$ characteristic; e.g., $\gamma$=2.2). The shift from the luminance on the predetermined input grayscale level vs. luminance characteristic may be evaluated on all the grayscale levels forming the input grayscale level vs. luminance characteristic (e.g., 256 grayscale levels of 0 to 255), or may be evaluated only on a part of the grayscale levels (e.g., intermediate grayscale that has a relatively large influence on the display quality). The shift from the luminance on the predetermined input grayscale level vs. luminance characteristic may be evaluated by finding the difference of the luminance acquired by the acquisition portion 13 from the luminance on the predetermined input grayscale level vs. luminance characteristic, or may be evaluated by calculating a grayscale correction amount as described with reference to FIG. 2.

As described below with reference to, for example, FIG. 4 and FIG. 7, the specification portion may specify the at least one abnormal pixel and the at least one correction target grayscale level based on a grayscale level and a pixel having a luminance having a maximum of the shift evaluated by the luminance shift evaluation portion.

Hereinafter, an example of the specification portion of the correction data generating device 10 will be described in more detail.

The determination portion 14 determines whether or not the luminance value of each of the captured images acquired by the acquisition portion 13 matches a predetermined luminance value Ln corresponding to a grayscale level N of the image corresponding to the each captured image for whether or not the difference between the luminance value of each of the captured images and the predetermined luminance value Ln is within a predetermined threshold value). The "predetermined luminance value Ln corresponding to a grayscale level N" may be, for example, a luminance value at an arbitrary grayscale level N (N is, for example, 0 to 255) on a normal grayscale level vs. luminance characteristic.

In the case where the luminance value of a certain pixel in the captured image matches the predetermined luminance value Ln at a certain grayscale level N (or in the case where the difference between the luminance value of the certain pixel and the predetermined luminance value Ln is within the predetermined threshold value), it is considered that the luminance of the certain pixel and the grayscale level N are on the normal grayscale level vs. luminance characteristic. In the case where the luminance value of a pixel in the captured image does not match the predetermined luminance value Ln at a certain grayscale level N (or in the case where the difference between the luminance value of the pixel and the predetermined luminance value Ln is out of the predetermined threshold value), it is considered that the luminance of the pixel and the grayscale level N are not on the normal grayscale level vs. luminance characteristic and that the luminance abnormality is occurring.

The region specification portion 20 specifies the pixel determined by the determination portion 14 as having a luminance value not matching the predetermined luminance value Ln (or determined as having a luminance value different from the predetermined luminance value Ln by a difference out of the predetermined threshold value), the pixel being specified as an abnormal pixel, the input grayscale level vs. luminance characteristic of which needs to be corrected. The region specification portion 20 may specify a region including the abnormal pixel.

In the case where the determination portion 14 determines that the luminance value of a pixel does not match the predetermined luminance value Ln, the calculation portion 17 calculates the grayscale correction amount at the grayscale level N based on the predetermined grayscale level vs. luminance characteristic, the luminance value of each of the captured images and the predetermined luminance value Ln. The predetermined grayscale level vs. luminance characteristic is a grayscale level vs. luminance characteristic of a position with no luminance abnormality (grayscale level vs. luminance characteristic of the normal position).

Figure 2:
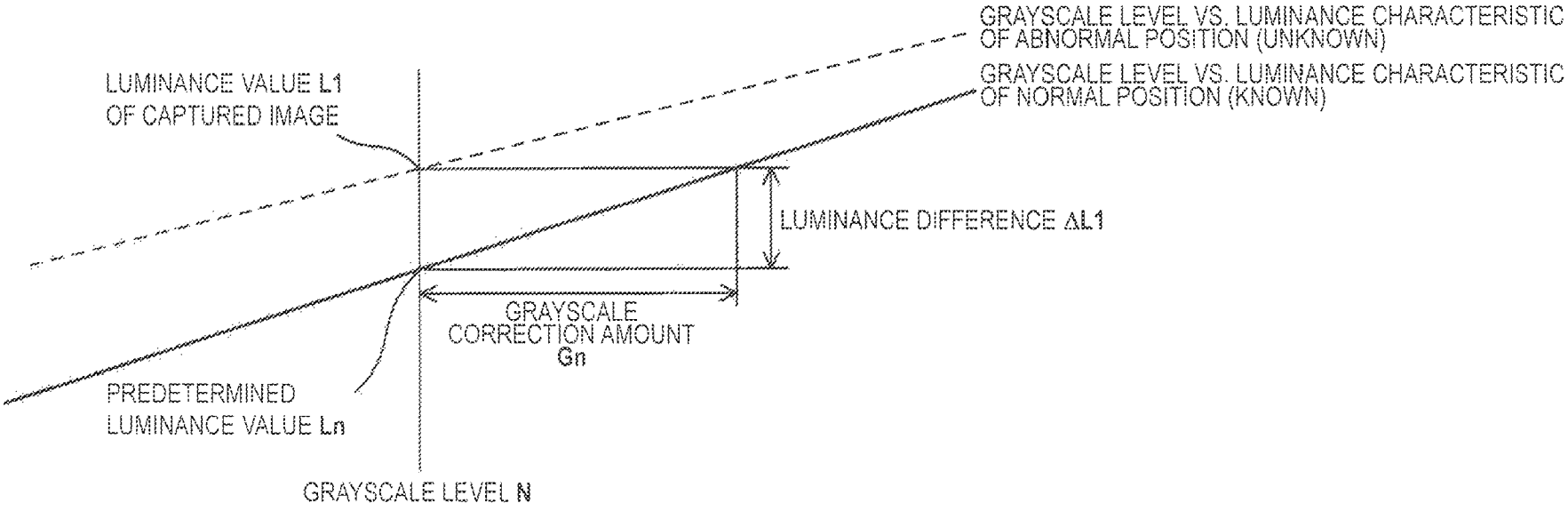
FIG. 2 shows an example of method for calculating a grayscale correction amount by a calculation portion according to an embodiment.

FIG. 2 shows an example of a method for calculating the grayscale correction amount by the calculation portion 17 according to an embodiment. In FIG. 2, the solid line represents the grayscale level vs. luminance characteristic of the normal pixel (known), and the dashed line represents the grayscale level vs. luminance characteristic of the abnormal pixel (unknown). An arbitrary grayscale level is represented by N.

As shown in FIG. 2, the luminance value of the captured image obtained by the image capturing performed on an image of the grayscale level N (more specifically, the luminance value of a pixel in the captured image) is represented by L1, and the predetermined luminance value corresponding to the grayscale level N is represented by Ln. The predetermined luminance value Ln is a luminance value on the grayscale level vs. luminance characteristic of the normal position. The luminance difference between the luminance value L1 and the predetermined luminance value Ln is represented by $\Delta$L1. The calculation portion 17 calculates, as a grayscale correction amount Gn, a grayscale level difference corresponding to the luminance difference $\Delta$L1 between the luminance value L1 and the predetermined luminance value Ln, on the grayscale level vs. luminance characteristic of the normal position.

Figure 3:
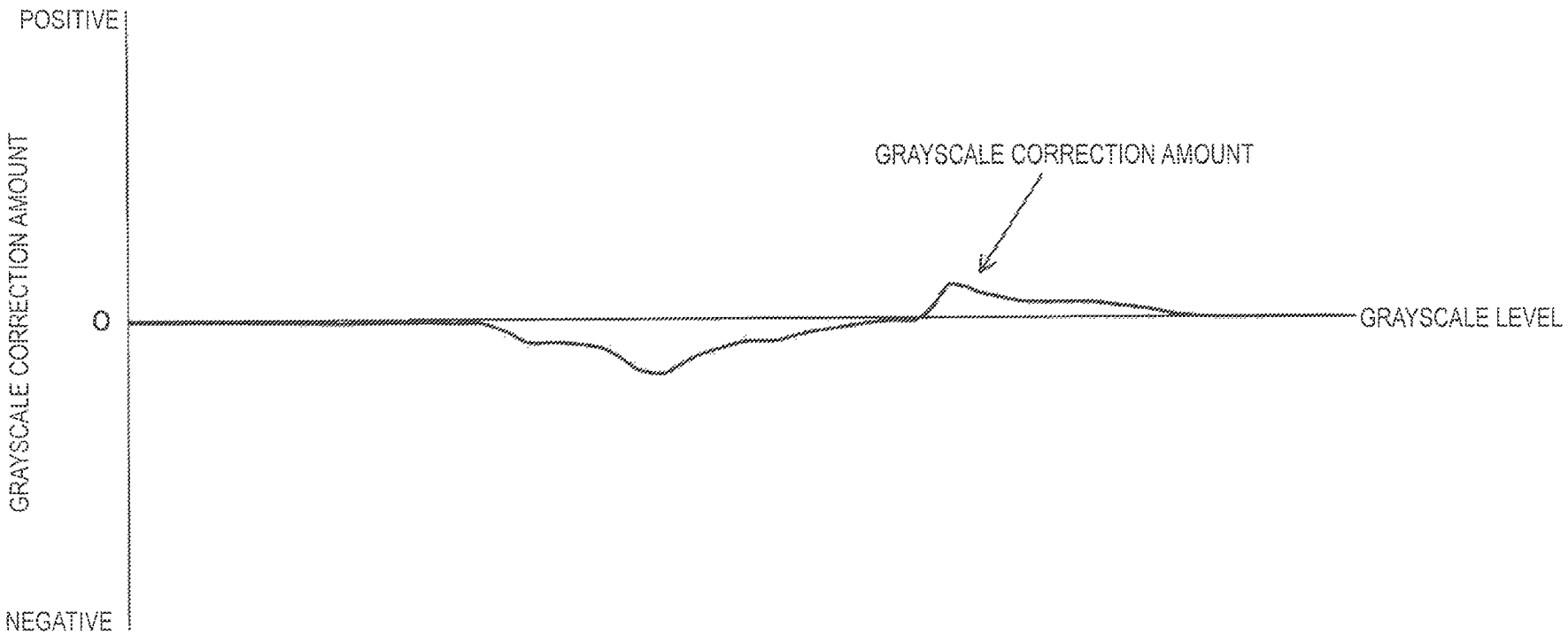
FIG. 3 is a schematic view showing an example of distribution of the grayscale correction amount.

FIG. 3 is a schematic view showing an example of distribution of the grayscale correction amount of a certain pixel. In FIG. 3, the horizontal axis represents the grayscale level, which may include, for example, grayscale level 0 to grayscale level 255. The vertical axis represents the grayscale correction amount. As shown in FIG. 3, the distribution of the grayscale correction amount at all the grayscale levels may be found. In the case where the grayscale correction amount at the grayscale level N is of positive value, the luminance value of the certain pixel at the grayscale level N is smaller than the predetermined luminance value Ln. This indicates luminance abnormality by which the luminance of the certain pixel is lower than the luminance of the pixels around the certain pixel. In the case where the grayscale correction amount at the grayscale level N is of a negative value, the luminance value of the certain pixel at the grayscale level N is larger than the predetermined luminance value Ln. This indicates luminance abnormality by which the luminance of the certain pixel is higher than the luminance of the pixels around the certain pixel.

The grayscale correction amount shown in FIG. 3 is one example, and the grayscale correction amount is not limited to being distributed as shown in FIG. 3. The distribution of the grayscale correction amount varies depending on the position of each of the pixels in the display region 1. For example, the grayscale correction amount of a position with no luminance abnormality (normal pixel) is 0 at the all grayscale levels. The grayscale correction amount or a position with luminance abnormality (abnormal pixel) may be distributed in a different manner depending on the position of the pixel.

The extraction portion 15 extracts a correction target grayscale level range based on the grayscale level N of one or a plurality of pixels each corresponding to one or a plurality of captured images determined by the determination portion 14 as having a luminance value not matching the predetermined luminance value Ln.

Figure 4:
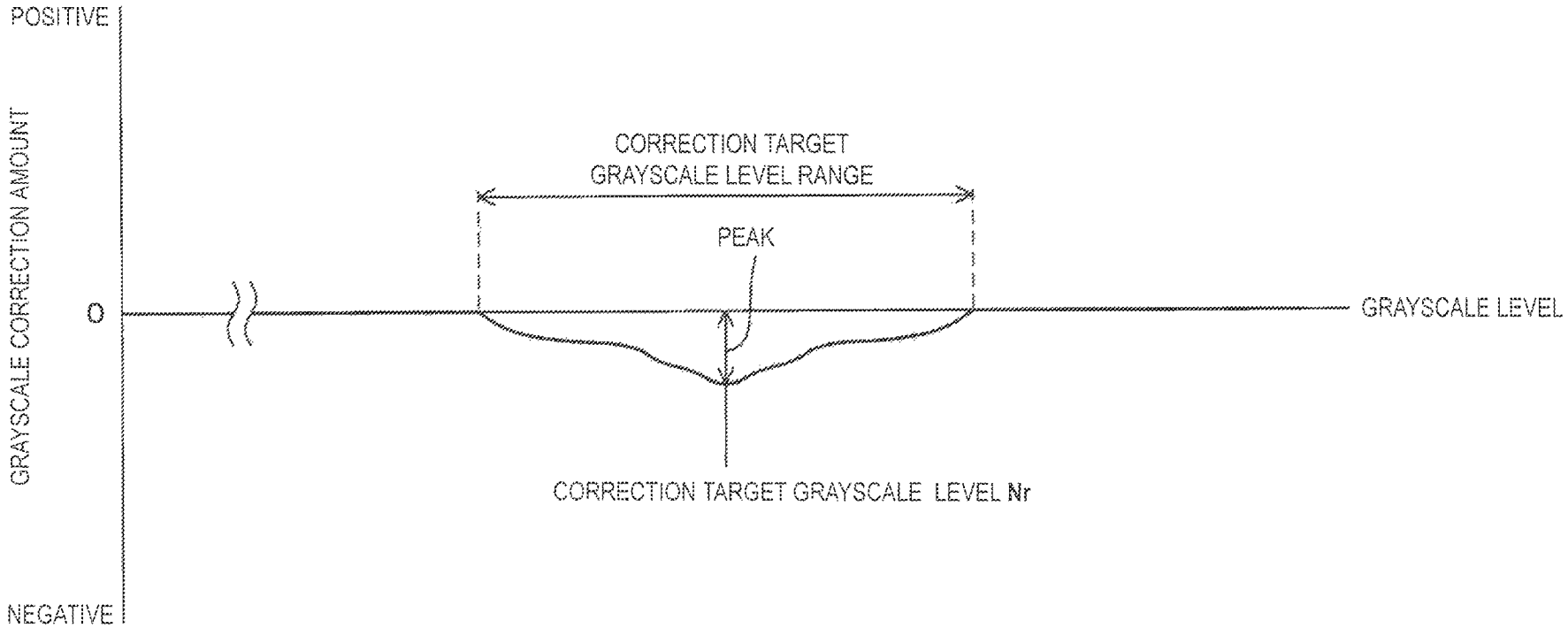
FIG. 4 is a schematic view showing an example of correction target grayscale level range.

FIG. 4 is a schematic view showing an example of correction target grayscale level range. In FIG. 4, the horizontal axis represents the grayscale level, and the vertical axis represents the grayscale correction amount. As shown in FIG. 4, a grayscale level range including a grayscale level at which the grayscale correction amount calculated by the calculation portion 17 is of a positive value or of a negative value but is not zero may be extracted as the correction target grayscale level range. Namely, the extraction portion 15 may extract, as the correction target grayscale level range, the grayscale level range including one or a plurality of grayscale levels at which the luminance abnormality is considered to be occurring. The luminance abnormality may be occurring at all the grayscale levels included in the correction target grayscale level range, or the luminance abnormality may be occurring only at a part of the grayscale levels included in the correction target grayscale level range.

The grayscale level specification portion 16 specifies one or a plurality of correction target grayscale levels based on the correction target grayscale level range extracted by the extraction portion 15. For example, the grayscale level specification portion 16 may specify, as a correction target grayscale level Nr, the grayscale level at which the luminance abnormality is largest among the grayscale levels included in the correction target grayscale level range.

With the above-described structure, the correction target grayscale level is specified based on the extracted correction target grayscale level range. Therefore, even in the case where there is a pixel at which the luminance abnormality is large at an arbitrary grayscale level, the grayscale level to be corrected may be easily specified.

The grayscale level specification portion 16 may specify, as the correction target grayscale levels, a required number of grayscale levels, among the grayscale levels included in the correction target grayscale level range, in descending order of largeness of the luminance abnormality.

More specifically, the grayscale level specification portion 16 may specify the correction target grayscale level(s) Nr based on the grayscale correction amount calculated by the calculation portion 17. With such an arrangement, the grayscale level(s) to be corrected may be specified in consideration of the degree of the luminance abnormality.

As shown in FIG. 4, the grayscale level specification portion 16 may specify the correction target grayscale level based on the grayscale level of an image corresponding to a captured image having a maximum absolute value of the grayscale correction amount calculated by the calculation portion 17. Namely, the grayscale level specification portion 16 may specify, as the correction target grayscale level Nr, the grayscale level having a maximum absolute value of the grayscale correction amount Gn required for the correction. With such an arrangement, even in the case where there is a pixel at which the luminance abnormality is large at an arbitrary grayscale level, the grayscale level to be corrected may be easily specified. In the example of FIG. 4, only one correction target grayscale level Nr is specified. The present invention is not limited to this. A plurality of correction target grayscale levels Nr may be specified.

As described above, the grayscale level specification portion 16 specifies the correction target grayscale level(s) Nr based on each of the captured images obtained by the image capturing performed by the camera 50 in correspondence with the images displayed respectively at the arbitrary grayscale levels. Such correction target grayscale levels Nr are some desired grayscale levels among all the grayscale levels, and are grayscale levels that are to be corrected. The correction target grayscale level(s) Nr may be, for example, grayscale levels at which the luminance abnormality is large. For the grayscale levels other than the correction target grayscale level(s) Nr, correction data may be found by interpolation or the like based on the correction data obtained at the correction target grayscale level(s) Nr.

The generation portion 19 generates the correction data based on the correction target grayscale level(s) Nr specified by the grayscale level specification portion 16. In the case where, for example, luminance abnormality by which the luminance of the abnormal position (pixel at which the luminance abnormality is occurring) is higher than the luminance of the region around the abnormal position is occurring, correction data is generated such that when the grayscale level is corrected to decrease the luminance of the abnormal position and where the grayscale difference before and after the correction is, for example, −5, the correction value for the abnormal position is −5.

Similarly, in the case where luminance abnormality by which the luminance of the abnormal position (pixel at which the luminance abnormality is occurring) is lower than the luminance of the region around the abnormal position is occurring, correction data is generated such that when the grayscale level is corrected to increase the luminance of the abnormal position and where the grayscale difference before and after the correction is, for example, +5, the correction value for the abnormal position is +5. The correction value with no correction (initial value) may be, for example, zero.

As described above, the image is displayed at each of the arbitrary grayscale levels to specify the correction target grayscale level(s), and the correction data is generated based on the specified correction target grayscale level(s). With such an arrangement, even in the case where the luminance abnormality is large, the grayscale level to be corrected may be easily specified. In addition, since the correction data is generated for the specified correction target grayscale level, the luminance non-uniformity can be corrected more precisely.

Now, a method for generating the correction data based on the specified correction target grayscale level will be specifically described.

Figure 5:
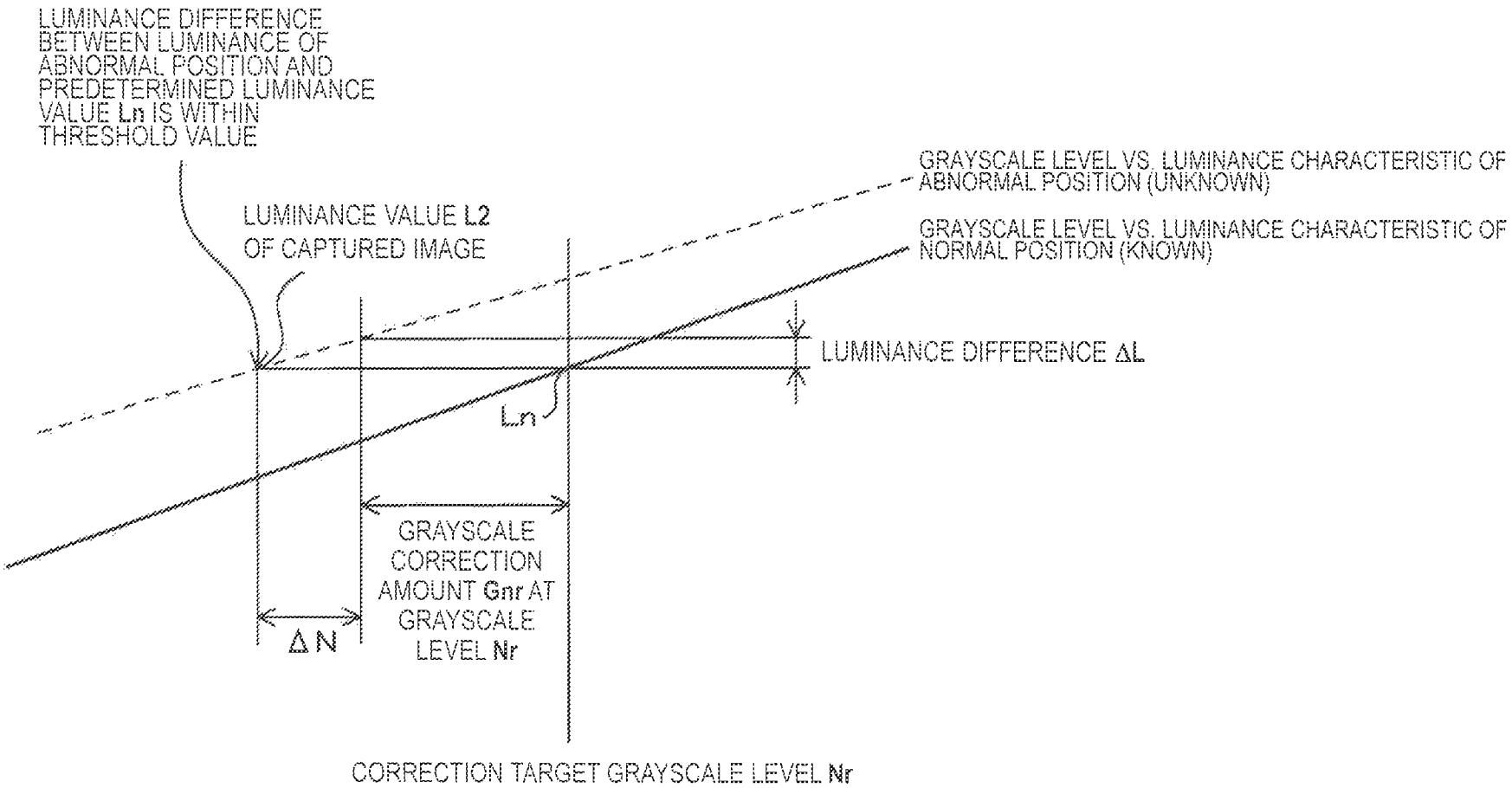
FIG. 5 is a schematic view showing an example of method for generating correction data by the correction data generating device according to an embodiment.

FIG. 5 is a schematic view showing an example of method for generating the correction data by the correction data generating device 10 according to an embodiment. In FIG. 5, the solid line represents the grayscale level vs. luminance characteristic of the normal pixel (known), and the dashed line represents the grayscale level vs. luminance characteristic of the abnormal pixel (unknown). In the following, the correction target grayscale level will be represented by Nr, and the description will be made with an assumption that even if the correction is performed by use of a grayscale correction amount Gnr at the correction target grayscale level Nr, the luminance non-uniformity remains.

The display controller 12 performs control so as to display an image obtained by changing the grayscale level, from the correction target grayscale level Nr specified by the grayscale level specification portion 16, based on a predetermined grayscale level number and/or the grayscale correction amount Gnr. The predetermined grayscale level number is represented by ΔN. ΔN may be 1, or another numerical value of 2, 3 or the like. The display controller 12 displays, for example, an image of the grayscale level (Nr−1) or (Nr+1).

The luminance difference determination portion 18 determines whether or not the luminance difference between the luminance value of a captured image obtained by the image capturing performed by the camera 50 on an image of the grayscale level (Nr−ΔN) displayed in the display region 1 and the predetermined luminance value Ln corresponding to the correction target grayscale level Nr is within a predetermined threshold value.

As shown in FIG. 5, the grayscale correction amount at the correction target grayscale level Nr is represented by Gnr, and the luminance difference between the luminance value obtained by correcting the grayscale level by the grayscale correction amount Gnr and the predetermined luminance value Ln is represented by ΔL. The luminance difference ΔL is caused by the correction amount being excessive or insufficient when the grayscale level is corrected at the correction target grayscale level Nr. In the case where the luminance difference between the luminance value of the pixel in a captured image obtained by the image capturing performed on an image of the grayscale level (Nr−Gnr−ΔN) and the predetermined luminance value Ln is within the predetermined threshold value, this indicates that the luminance value is decreased by approximately ΔL by changing the grayscale level by ΔN from Nr−Gnr. In this manner, the luminance non-uniformity is removed.

In the case where the luminance difference determination portion 18 determines that the luminance difference is within the predetermined threshold value, the generation portion 19 generates the correction data based on the grayscale level number Gnr+ΔN, by which the grayscale level is changed from the correction target grayscale level Nr.

As shown in FIG. 5, the grayscale correction amount at the correction target grayscale level Nr is represented by Gnr. In the case where the luminance difference between a luminance value L2 of the pixel in a captured image obtained by the image capturing performed on the image of the grayscale level (Nr−Gnr−ΔN) and the predetermined luminance value Ln is within the predetermined threshold value, the grayscale correction amount at the correction target grayscale level Nr may be (Gnr+ΔN). With such an arrangement, even if the grayscale level vs. luminance characteristic of the pixel at which the luminance abnormality is occurring is different from the normal grayscale level vs. luminance characteristic with no luminance abnormality, the luminance non-uniformity can be corrected accurately (precisely).

In the example shown in FIG. 5, the luminance non-uniformity is corrected by changing the grayscale level by the grayscale level number ΔN from the correction target grayscale level Nr−Gnr. In the case where the luminance non-uniformity is not removed by changing the grayscale level by the grayscale level number ΔN once, the following may be performed.

In the case where the luminance difference determination portion 18 determines that the luminance difference is not within the predetermined threshold value, the display controller 12 performs control so as to display an image obtained by further changing the grayscale level by the predetermined grayscale level number ΔN, and the process performed by the luminance difference determination portion 18 is repeated.

For example, the grayscale correction amount at the correction target grayscale level Nr is represented by Gnr. In the case where the luminance difference between the luminance value of the pixel in a captured image obtained by the capturing performed on the image of the grayscale level (Nr−Gnr−ΔN) and the predetermined luminance value Ln is not within the predetermined threshold value, the display controller 12 displays, for example, an image of the grayscale level (Nr−Gnr−2×ΔN). In the case where the luminance value of the pixel in a captured image obtained by the image capturing performed on the image of the grayscale level (Nr−Gnr−2×ΔN) and the predetermined luminance value Ln is within the predetermined threshold value, the grayscale correction amount at the correction target grayscale level Nr may be (Gnr+2×ΔN). With such an arrangement, even if the grayscale level vs. luminance characteristic of the abnormal pixel is different from the grayscale level vs. luminance characteristic of the normal pixel, the luminance non-uniformity can be corrected accurately (precisely).

Herein, an example in which the grayscale level is changed from the correction target grayscale level Nr based on the predetermined grayscale level number ΔN and the grayscale correction amount Gnr. Alternatively, the grayscale level may be changed from the correction target grayscale level Nr by an integer multiple of the predetermined grayscale level number ΔN with no use of the grayscale correction amount Gnr. It is determined whether or not the luminance difference between the luminance of the pixel supplied with a display signal voltage corresponding to the grayscale level (Nr−ΔN) and the predetermined luminance value Ln is within the predetermined threshold value. In the case where the luminance difference is not within the predetermined threshold value, the process may be repeated with ΔN=ΔN+ΔN until it is determined that the luminance difference is within the predetermined threshold value. In this case, the calculation of the grayscale correction amount Gnr may be omitted.

In the above-described example, a case where the grayscale level is changed by the predetermined grayscale level number ΔN from the correction target grayscale level Nr in a direction in which the grayscale level is decreased. In the case where the luminance abnormality is darker than the region around the luminance abnormality, the grayscale level may be changed by the predetermined grayscale level number ΔN from the correction target grayscale level Nr in a direction in which the grayscale level is increased.

Figure 6:
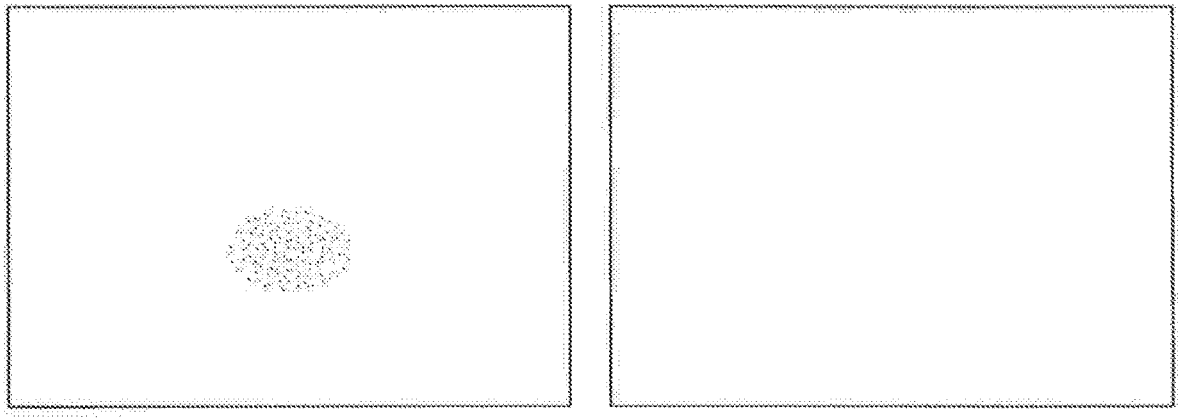
FIG. 6 is a schematic view showing an example of state of a display panel provided by the correction performed by the correction data generating device according to an embodiment.

FIG. 6 is a schematic view showing an example of state of the display panel obtained by the correction made by the correction data generating device 10 according to an embodiment. As shown in the left view of FIG. 6, before the correction of the luminance non-uniformity, the luminance non-uniformity (region represented with a pattern for the sake of convenience) is generated in the vicinity of the center of the display panel. The luminance abnormality may be darker or brighter than the region around the luminance abnormality. As shown in the right view of FIG. 6, the luminance non-uniformity is removed by the correction performed by the correction data generating device 10.

Figure 7:
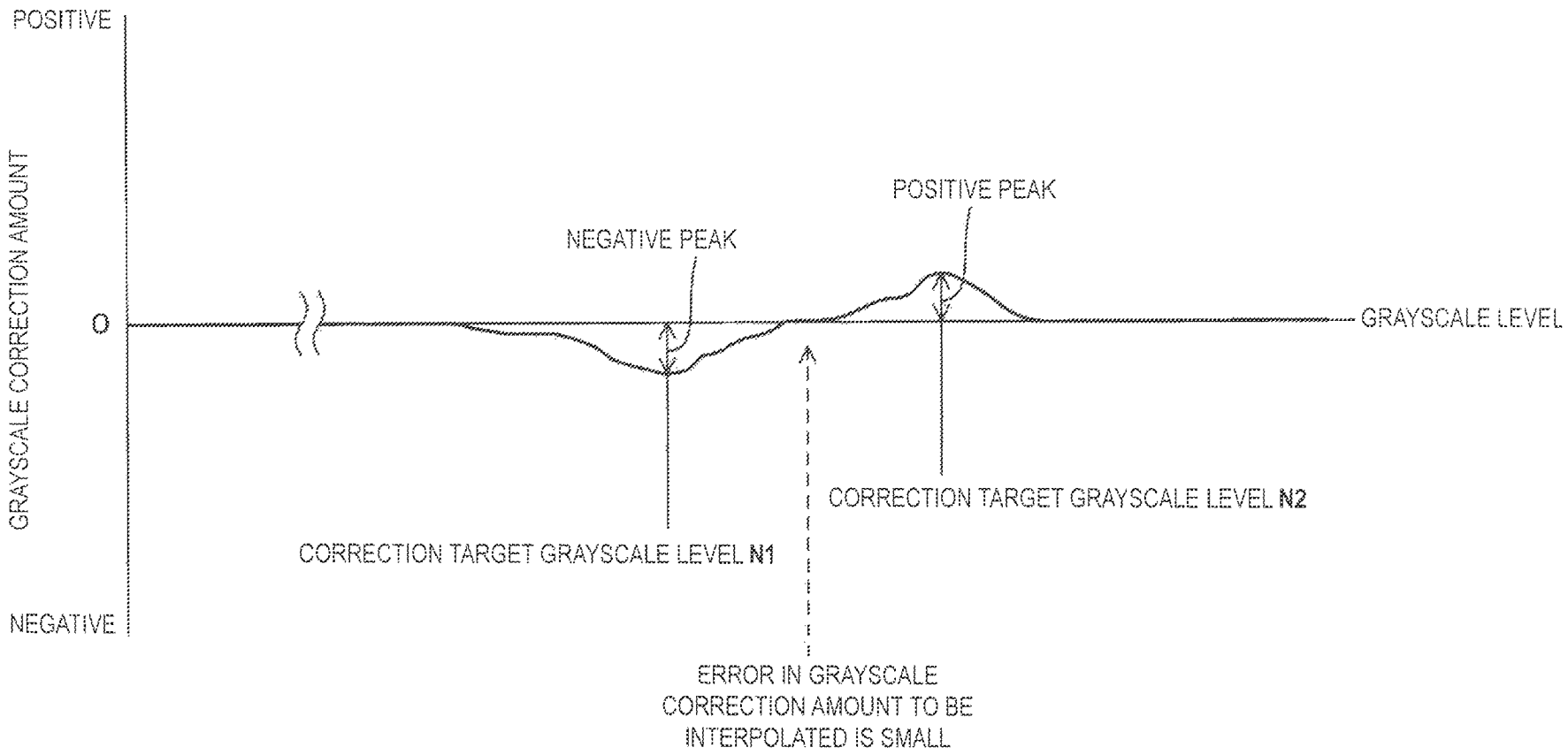
FIG. 7 is a schematic view showing another example of method for specifying a correction target grayscale level by the correction data generating device according to an embodiment.

FIG. 7 is a schematic view showing another example of method for specifying the correction target grayscale level by the correction data generating device 10 according to an embodiment. The grayscale level specification portion 16 specifies a correction target grayscale level(s) based on two grayscale levels of two images corresponding to two captured images for which the sum of two grayscale correction amounts calculated by the calculation portion 17 is minimum.

A case where the sum of the two grayscale correction amounts is minimum may be, for example, as shown in FIG. 7, a case where one of the grayscale correction amounts is of a maximum negative value and the other grayscale correction amount is of a maximum positive value. It is further preferred that one of the grayscale correction amounts is of a negative value and the other grayscale correction amount is of a positive value that is generally equal to an absolute value of the one grayscale correction amount.

Where the two correction target grayscale levels are N1 and N2, the sum of the grayscale correction amounts at the correction target grayscale levels N1 and N2 is minimum. Therefore, in the case where the grayscale correction amount is interpolated between the correction target grayscale levels N1 and N2, the error in the correction amount may be decreased, and the correction may be performed such that the luminance abnormality is removed even at the grayscale levels as the interpolation targets.

In the example shown in FIG. 7, the two grayscale correction amounts are of positive and negative values. The two grayscale correction amounts are not limited to this, and the two grayscale correction amounts may both be of positive or negative values. In the case where, for example, the two grayscale correction amounts are both of positive values, the two correction target grayscale levels N1 and N2 may be specified such that the grayscale correction amount between the two grayscale correction amounts change linearly. With such an arrangement, in the case where the grayscale correction amount is interpolated between the correction target grayscale levels N1 and N2, the error in the correction amount may be decreased, and the correction may be performed such that the luminance abnormality is removed even at the grayscale levels as the interpolation targets.

In the case where the luminance difference determination portion 18 determines that the luminance difference between the luminance value of the captured image and the predetermined luminance value Ln is not within the predetermined threshold value, the region specification portion 20 specifies a luminance-abnormal region formed of a pixel(s) of such a luminance value.

The display controller 12 performs control so as to display an image obtained by changing the grayscale level of the region specified by the region specification portion 20 by the predetermined grayscale level number. With such an arrangement, it is merely needed to change the grayscale level of the region in which the luminance abnormality is occurring (luminance-abnormal region). Thus, the process is simplified.

Figure 8:
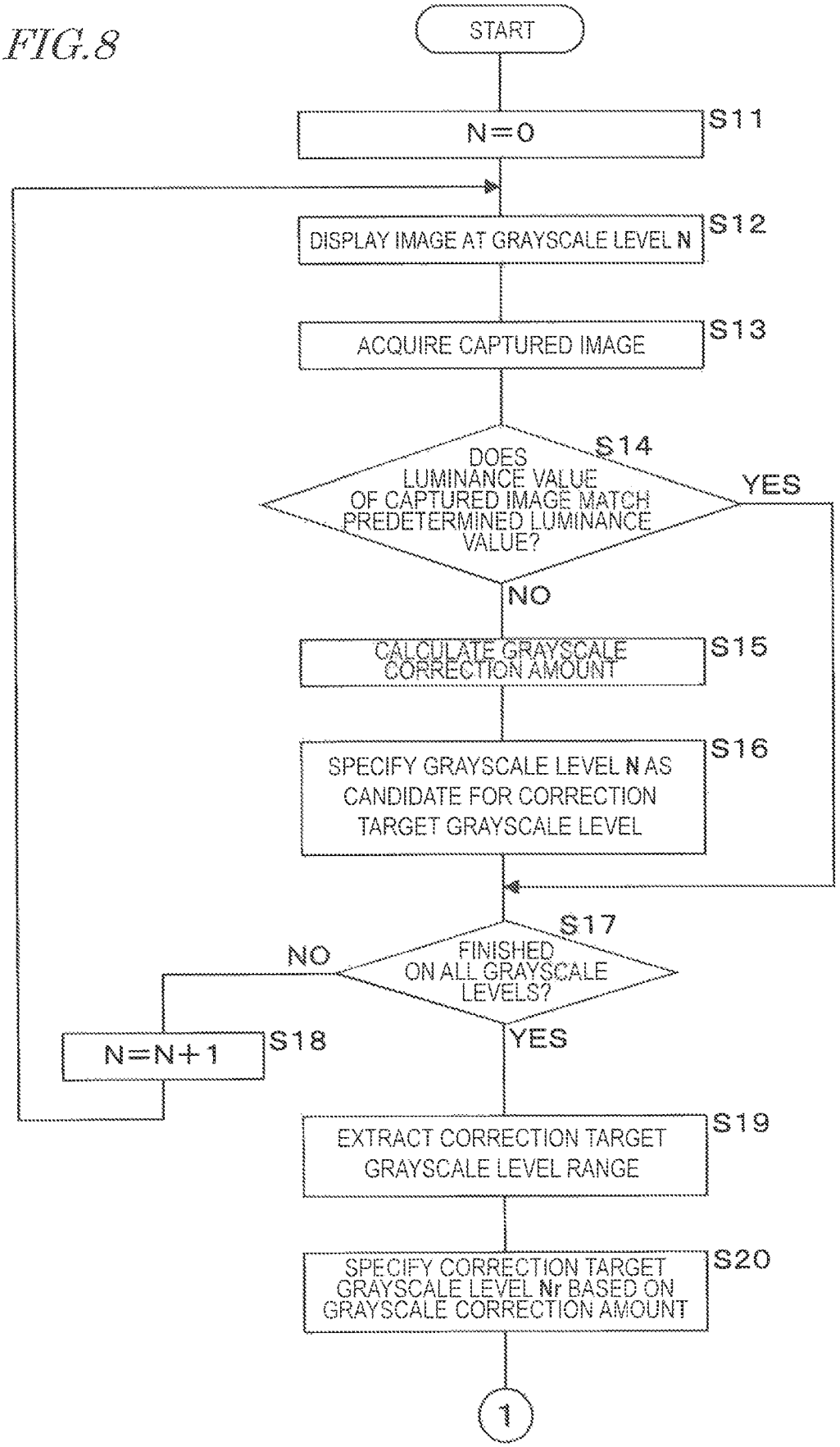
FIG. 8 is a flowchart showing an example of procedure of processes performed by the correction data generating device according to an embodiment.
Figure 9:
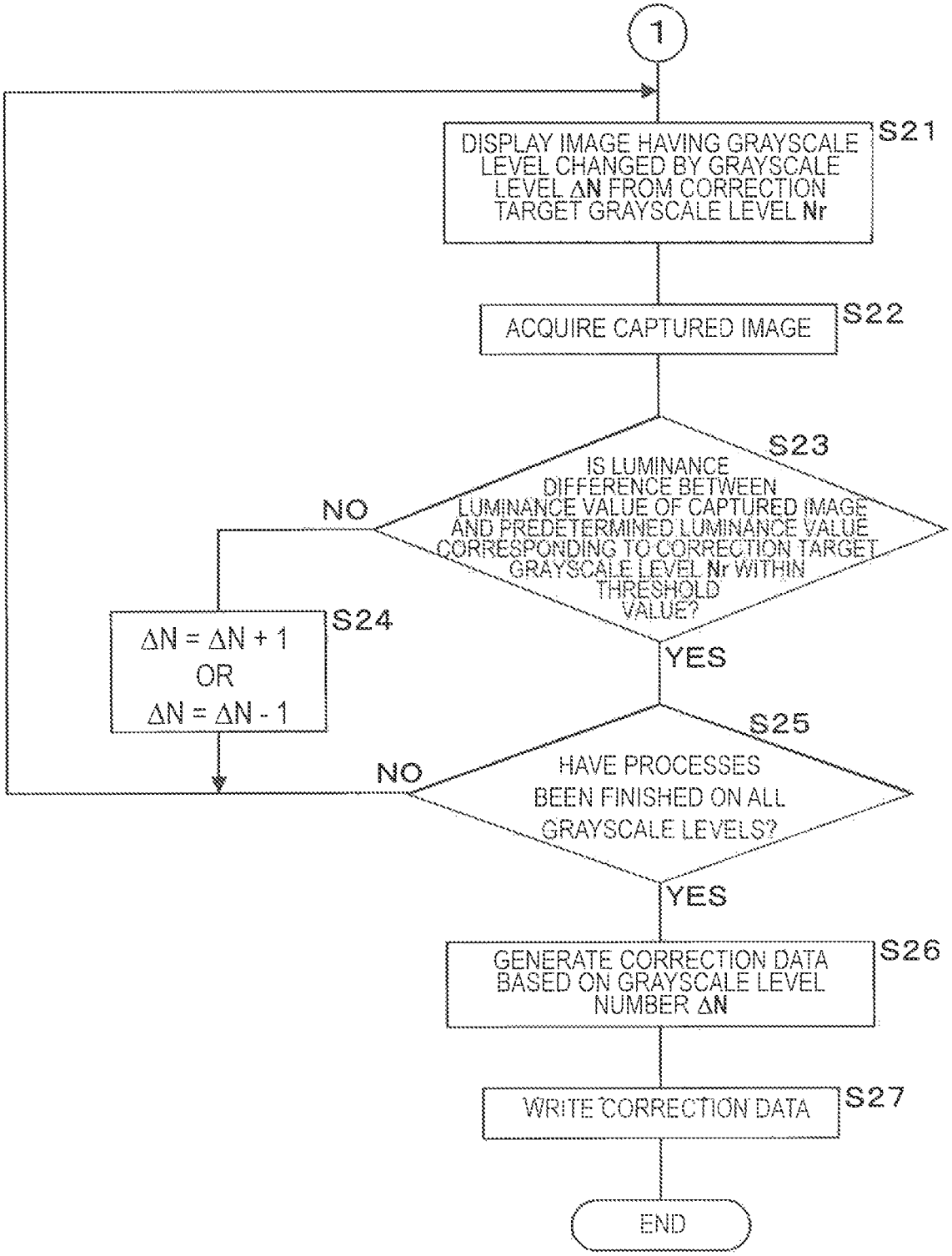
FIG. 9 is a flowchart showing the example of procedure of processes performed by the correction data generating device according to an embodiment.
Figure 10:
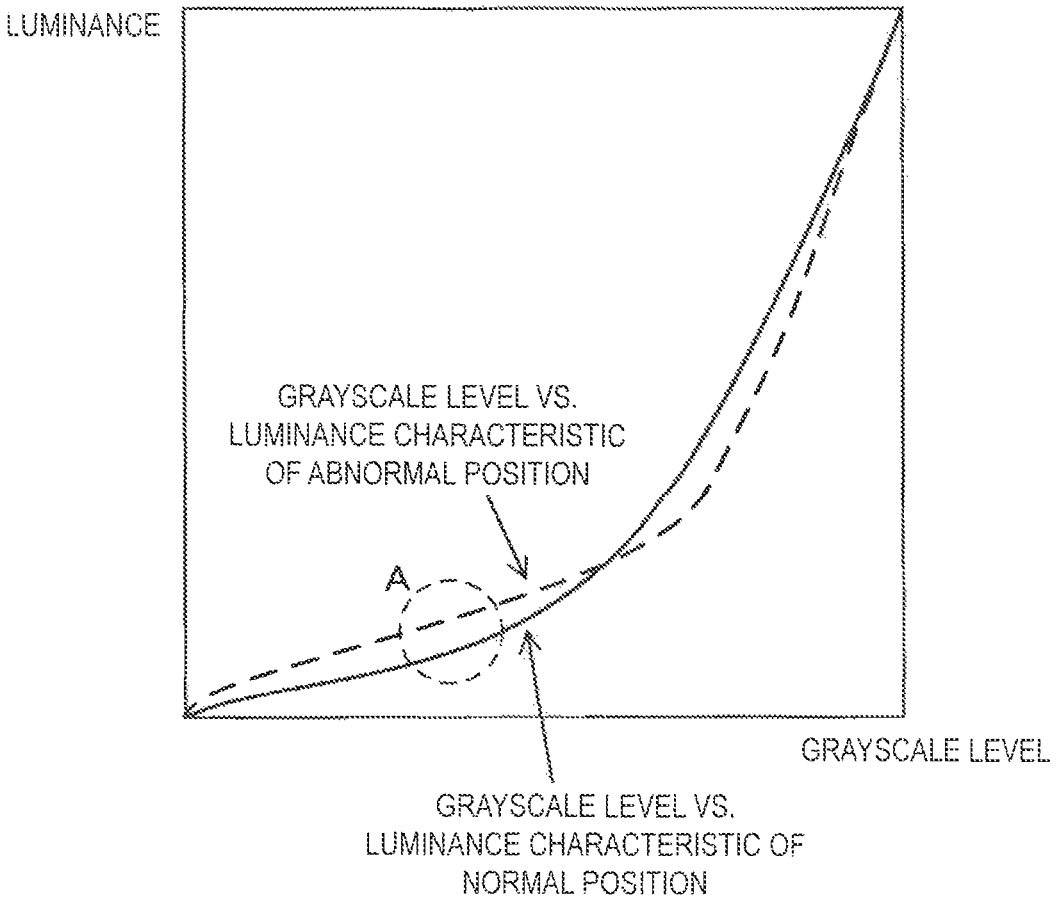
FIG. 10 shows an example of grayscale level vs. luminance characteristic of a display panel.
Figure 11:
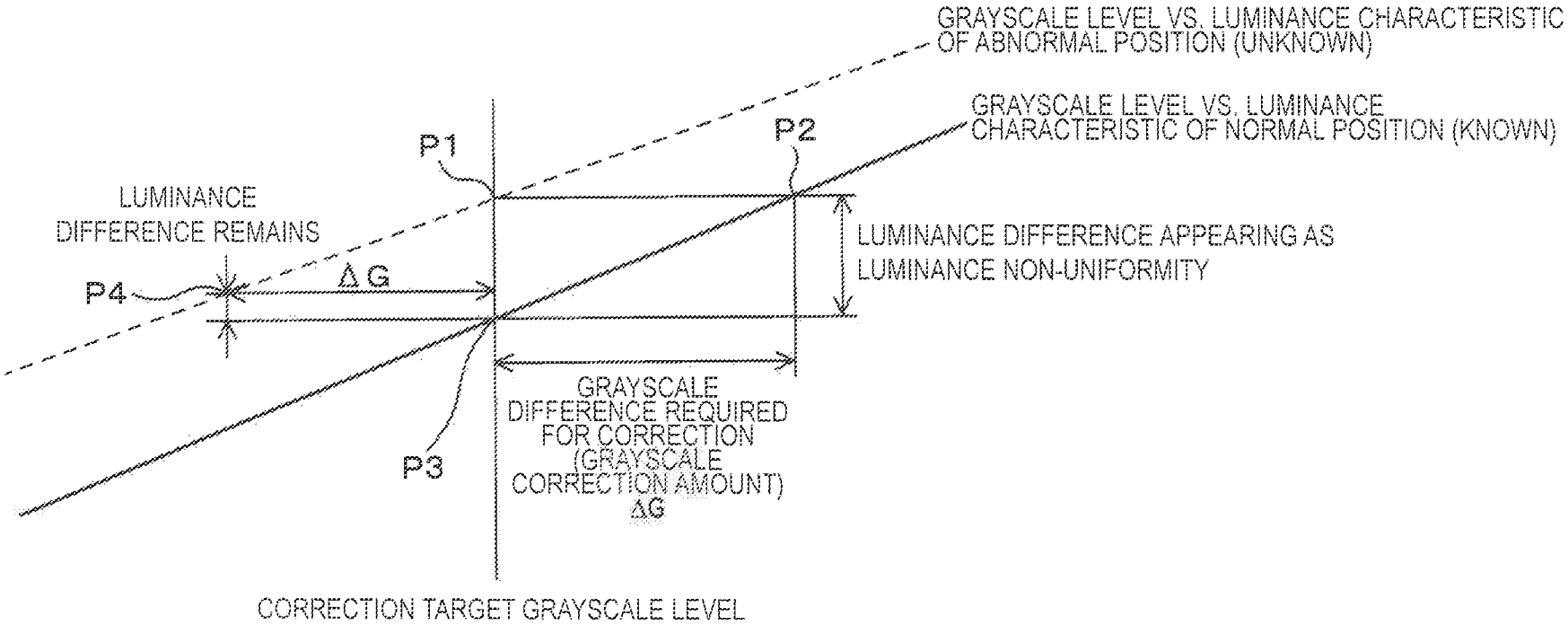
FIG. 11 shows an example of conventional method for correcting the luminance non-uniformity.
Figure 12:
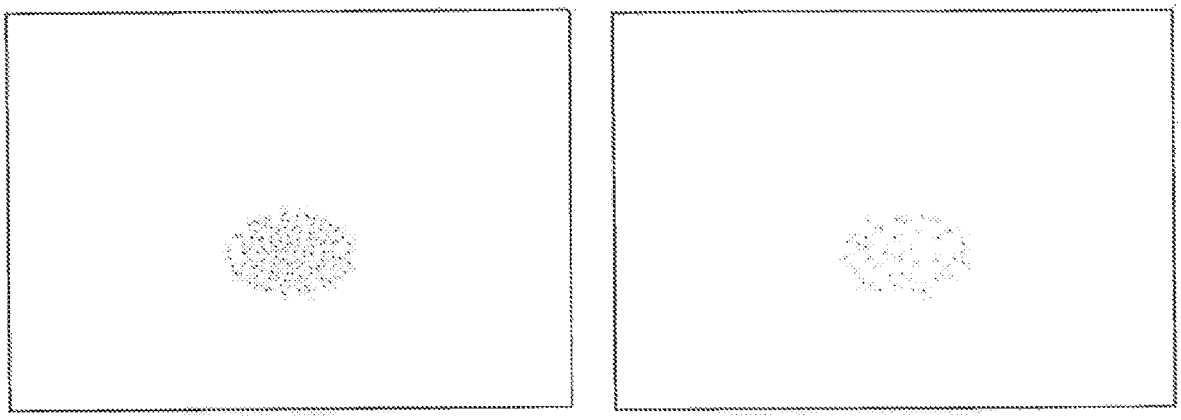
FIG. 12 is a schematic view showing an example of state of a display panel provided by the correction performed by a conventional correction data generating device.

Now, an operation of the correction data generating device 10 according to an embodiment will be described. FIG. 8 and FIG. 9 are flowcharts showing an example of procedure of processes performed by the correction data generating device 10. In the following, the controller 11 will be described as the subject that performs the processes, for the sake of convenience. The controller 11 sets the grayscale level N to N=0 (S11), and displays an image of the grayscale level N (S12). N may be, for example, 0 to 255, but is not limited to this example.

The controller 11 acquires a captured image obtained by the image capturing performed on an image of the grayscale level N by the camera 50 (captured image corresponding to the image of the grayscale level N) (S13), and determines whether or not the luminance value of the captured image matches the predetermined luminance value Ln (S14). Here, the predetermined luminance value Ln is a luminance value corresponding to the grayscale level N on the grayscale level vs. luminance characteristic of the normal pixel.

In the case where the luminance value of the captured image does not match the predetermined luminance value Ln, (NO in S14), the controller 11 calculates the grayscale correction amount Gn (S15). The grayscale correction amount Gn is a grayscale level difference corresponding to the luminance difference between the luminance value of the captured image and the predetermined luminance value Ln, on the normal grayscale level vs. luminance characteristic. The controller 11 specifies the grayscale level N as a candidate for the correction target grayscale level (S16). In the case where the luminance value of the captured image matches the predetermined luminance value (YES in S14), the controller 11 executes a process in step S17 described below. As described above, the step of calculating the grayscale correction amount Gn (S15) is optional.

The controller 11 determines whether or not the above-described processes have been finished on all the grayscale levels (S17). For example, in the case of N=255, it may be determined that the processes have been finished on all the grayscale levels. In the case where the processes have not been finished on all the grayscale levels (NO in S17), the controller 11 sets N to N=N+1 (S18), and repeats the processes in step S12 end thereafter. In the case where the processes have been finished on all the grayscale levels (YES in S17), the controller 11 extracts the correction target grayscale level range (S19), and specifies the correction target grayscale level Nr based on the calculated grayscale correction amounts (S20). The number of the correction target grayscale level Nr is not limited to one, and a plurality of correction target grayscale levels Nr may be specified.

The controller 11 displays an image of a grayscale level changed by the grayscale level number ΔN from the correction target grayscale level Nr (S21). The grayscale level number ΔN may be +1 or −1, but is not limited to ±1. In the case where the luminance of the abnormal pixel is higher than the luminance of the pixels around the abnormal pixel, ΔN may be set to −1. In the case where the luminance of the abnormal pixel is lower than the luminance of the pixels around the abnormal pixel, ΔN may be set to +1.

The controller 11 acquires a captured image obtained by the image capturing performed by the camera 50 on an image of the grayscale level (Nr−ΔN) or an image of the grayscale level (Nr+ΔN) (S22), and determines whether or not the luminance difference between the luminance value of the captured image and the predetermined luminance value Ln corresponding to the correction target grayscale level Nr is within the threshold value (S23). Here, the predetermined luminance value Ln is a luminance value corresponding to the correction target grayscale level Nr on the normal grayscale level vs. luminance characteristic.

In the case where the luminance difference is not within the threshold value (NO in S23), the controller 11 sets ΔN to ΔN=ΔN+1 or ΔN=ΔN−1 (S24), further changes the grayscale level by the grayscale level number ΔN and repeats the processed in step S21 and thereafter. In the case where the luminance difference is within the threshold value (YES in S23), the controller 11 determines whether or not the above-described processes have been finished on all the grayscale levels (S25). In the case where the processes have not been finished on all the grayscale levels (NO in S25), the controller 11 repeats the processes in step S21 and thereafter.

In the case where the processes have been finished on all the grayscale levels (YES in S25), the controller 11 generates correction data based on the grayscale level number ΔN (S26), writes the correction data (S27) and finishes the processes.

The correction data generating device 10 according to an embodiment may be realized by a general-purpose computer including a CPU (processor), a RAM and the like. Namely, a computer program defining the procedure of each of the processes as shown in FIG. 8 and FIG. 9 is loaded on the RAM included in the computer and executed by the CPU (processor). In this manner, the correction data generating device 10 may be realized on the computer.

In the above-described embodiment, it is assumed that in the region where the luminance non-uniformity is occurring, the luminance abnormality brighter than the region around the luminance abnormality and the luminance abnormality darker than the region around the luminance abnormality are occurring at the same time. In such a case, the grayscale level is changed such that the luminance of the region having the higher luminance is decreased and such that the luminance of the region having the lower luminance is increased. In this manner, the number of times the camera 50 captures the images may be decreased.

In the above-described embodiment, the signal generation circuit 40 and the correction data generating device 10 are described as separate devices. The present invention is not limited to this. The signal generation circuit 40 may be incorporated into the correction data generating device 10.

The structures described in the above-described examples may be combined with each other. Such a combination may provide a new technological feature.

As described above, the correction data generating method according to an embodiment of the present invention is a method for generating correction data for correcting input grayscale level vs. luminance characteristics of a plurality of pixels included in a display region of a display panel, and includes the following steps.

step (A): step of supplying each of the plurality of pixels with display signal voltages corresponding to two or more grayscale levels;

step (B): step of acquiring two or more luminances of each of the plurality of pixels supplied with the display signal voltages respectively corresponding to the two or more grayscale levels;

step (C): step of specifying, among the plurality of pixels, at least one abnormal pixel, the input grayscale level vs. luminance characteristic of which needs to be corrected and also specifying at least one correction target grayscale level including a grayscale level that needs to be corrected, based on the two or more luminances, acquired in step (B), of each of the plurality of pixels; and step (D): step of generating correction data based on the at least one abnormal pixel and the at least one correction target grayscale level specified in step (C).

The display signal voltage supplied in step (A) may correspond to, for example, all of grayscale levels except for a lowest grayscale level (i.e., black) among grayscale levels (e.g., 256 grayscale levels of 0 to 255) of the input grayscale level vs. luminance characteristics of the plurality of pixels, or may correspond to three or more grayscale levels that are every predetermined number of grayscale levels (e.g., every other grayscale levels).

After step (c), step (A) and step (B) may be further performed. The display signal voltages supplied in step (A) performed after step (C) corresponds to two or more grayscale levels including the at least one correction target grayscale level. Namely, the correction data generating method according to an embodiment may further include, after step (C), step (A1) of supplying each of the plurality of pixels with display signal voltages corresponding to two or more grayscale levels including the at least one correction target grayscale level, and step (B1) of acquiring two or more luminances of each of the plurality of pixels supplied with the display signal voltages in step (A1). For example, the two or more grayscale levels in step (A) include three or more grayscale levels that are every predetermined number of grayscale levels, and the two or more grayscale levels in step (A1) include three or more grayscale levels that are every predetermined number of grayscale levels smaller than the predetermined number of grayscale levels in the step (A).

Step (C) may include step (C1) of evaluating a shift from a luminance on a predetermined input grayscale level vs. luminance characteristic, regarding each of the two or more luminances, acquired in step (B), of each of the plurality of pixels. Step (C) includes, for example, a step of specifying the at least one abnormal pixel and the at least one correction target grayscale level based on a grayscale level and a pixel having a luminance having a maximum of the shift evaluated in step (C1).

The correction data generating device according to an embodiment is a correction data generating device generating correction data for correcting a luminance non-uniformity of a display region of a display panel. The correction data generating device includes a display controller performing control so as to sequentially display images respectively at arbitrary grayscale levels on the display region, a grayscale level specification portion specifying a correction target grayscale level based on each of captured images obtained by image capturing performed by an image capturing portion in correspondence with the images displayed respectively at the arbitrary grayscale levels, and a generation portion generating correction data based on the correction target grayscale level specified by the grayscale level specification portion.

The computer program according to an embodiment is a computer program causing a computer to generate correction data for correcting a luminance non-uniformity of a display region of a display panel. The computer program causes the computer to execute a process of performing control so as to sequentially display images respectively at the arbitrary grayscale levels on the display region, a process of causing an image capturing portion to capture each of the images displayed respectively at the arbitrary grayscale levels, a process of specifying a correction target grayscale level based on each of the captured images obtained by the image capturing performed by the image capturing portion in correspondence with the images, and a process of generating correction data based on the specified correction target grayscale level.

The correction data generating method according to an embodiment is a correction data generating method performed by a correction data generating device that generates correction data for correcting a luminance non-uniformity of a display region of a display panel. According to the correction data generating method, control is performed so as to sequentially display images respectively at the arbitrary grayscale levels on the display region, each of the images displayed respectively at the arbitrary grayscale levels is captured by an image capturing portion, a correction target grayscale level is specified based on each of the captured images obtained by the image capturing performed by the image capturing portion in correspondence with the images, and correction data is generated based on the specified correction target grayscale level.

The display controller performs control so as to sequentially display the images respectively at the arbitrary grayscale levels on the display region. In the case where, for example, the grayscale levels include 256 levels of 0 (black) to 255 (white), 256 images of grayscale levels of 0, 1, 2, . . . 255 may be sequentially displayed, or images of grayscale levels of 0, 2, 4, . . . 255 may be displayed with some grayscale levels being deleted. Alternatively, as the grayscale levels become larger (higher), the degree at which the grayscale levels are deleted may be increased. The image may be an image for inspection in which all the pixels exhibit the same grayscale level.

The grayscale level specification portion specifies a correction target grayscale level(s) based on each of the captured images obtained by the image capturing performed by the image capturing portion in correspondence with the images displayed respectively at the arbitrary grayscale levels. Such correction target grayscale levels are some desired grayscale levels among all the grayscale levels, and are grayscale levels that are to be corrected. The correction target grayscale level(s) may be, for example, grayscale levels at which the luminance abnormality is large. For the grayscale levels other than the correction target grayscale level(s), correction data may be found by interpolation or the like based on the correction data obtained at the correction target grayscale level(s).

The generation portion generates the correction data based on the correction target grayscale level(s) specified by the grayscale level specification portion. In the case where, for example, the luminance of the abnormal pixel is higher than the luminance of the region around the abnormal pixel, correction data is generated such that when the grayscale level is corrected to decrease the luminance of the abnormal pixel and where the grayscale difference before and after the correction is, for example, −5, the correction value for the abnormal pixel is −5. The correction value with no correction (initial value) may be, for example, zero.

As described above, the image is displayed at each of the arbitrary grayscale levels to specify the correction target grayscale level(s), and the correction data is generated based on the specified correction target grayscale level(s). With such an arrangement, even in the case where the luminance non-uniformity is large, the grayscale level to be corrected may be easily specified. In addition, since the correction data is generated for the specified correction target grayscale level, the luminance non-uniformity can be corrected more precisely.

The correction data generating device according to an embodiment includes a determination portion determining whether or not the luminance value of each of the captured images matches a predetermined luminance value corresponding to the grayscale level of the image corresponding to the each captured image, and an extraction portion extracting a correction target grayscale level range based on the grayscale level of the image corresponding to the captured image determined by the determination portion as having a luminance value not matching the predetermined luminance value. The grayscale level specification portion specifies the correction target grayscale level(s) based on the correction target grayscale level range extracted by the extraction portion.

The determination portion determines whether or not the luminance value of each of the captured images matches a predetermined luminance value corresponding to the grayscale level of the image corresponding to the each captured image. The "predetermined luminance value corresponding to a grayscale level" may be a luminance value corresponding to an arbitrary grayscale level on a normal grayscale level vs. luminance characteristic. Namely, in the case where at a certain grayscale level, the luminance of a pixel in the captured image matches the predetermined grayscale level, the luminance of the pixel and the grayscale level are considered to be on a normal grayscale level vs. luminance characteristic. In the case where at a certain grayscale level, the luminance of a pixel in the captured image does not match the predetermined grayscale level, the luminance of the pixel and the grayscale level are considered not to be on a normal grayscale level vs. luminance characteristic, and it is considered that luminance abnormality is occurring.

The extraction portion extracts the correction target grayscale level range based on the grayscale level of the image corresponding to the captured image determined by the determination portion as having a luminance value not matching the predetermined luminance value. For example, the extraction portion may extract, as the correction target grayscale level range, the grayscale level range including one or a plurality of grayscale levels at which the luminance abnormality is considered to be occurring. The luminance abnormality may be occurring at all the grayscale levels included in the correction target grayscale level range, or the luminance abnormality may be occurring at a part of the grayscale levels included in the correction target grayscale level range.

The grayscale level specification portion specifies the correction target grayscale level(s) based on the correction target grayscale level range extracted by the extraction portion. For example, the grayscale level specification portion may specify, as a correction target grayscale level, the grayscale level at which the luminance abnormality is largest among the grayscale levels included in the correction target grayscale level range. Alternatively, the grayscale level specification portion may specify, as the correction target grayscale levels, a required number of grayscale levels, among the grayscale levels included in the correction target grayscale level range, in descending order of largeness of the luminance abnormality.

With the above-described structure, the correction target grayscale level is specified based on the extracted correction target grayscale level range. Therefore, even in the case where there is a pixel at which the luminance abnormality is large at an arbitrary grayscale level, the grayscale level to be corrected may be easily specified.

The correction data generating device according to an embodiment includes a calculation portion that, in the case where the determining portion determines that the luminance value does not match the predetermined luminance value, calculates a grayscale correction amount at the grayscale level based on the predetermined grayscale level vs. luminance characteristic, the luminance value of each of the above-mentioned captured images and the predetermined luminance value. The grayscale level specification portion specifies the correction target grayscale level(s) based on the grayscale correction amount(s) calculated by the calculation portion.

In the case where the determination portion determines that the luminance value does not match the predetermined luminance value, the calculation portion calculates the grayscale correction amount at the grayscale level based on the predetermined grayscale level vs. luminance characteristic, the luminance value of each of the captured images and the predetermined luminance value. The predetermined grayscale level vs. luminance characteristic is a grayscale level vs. luminance characteristic of a normal pixel. An arbitrary grayscale level is represented by N. The luminance value of the captured image obtained by capturing an image of the grayscale level N (more specifically, the luminance value of a pixel in the captured image) is represented by L1, and the predetermined luminance value corresponding to the grayscale level N is represented by Ln. The predetermined luminance value Ln is a luminance value on the grayscale level vs. luminance characteristic of the normal pixel. The luminance difference between the luminance value L1 and the predetermined luminance value Ln is represented by ΔL1. The calculation portion calculates, as the grayscale correction amount, a grayscale level difference corresponding to the luminance difference between the luminance value L1 and the predetermined luminance value Ln, on the grayscale level vs. luminance characteristic of the normal position.

The grayscale level specification portion specifies the correction target grayscale level(s) based on the grayscale level correction amount(s) calculated by the calculation portion. With such an arrangement, the grayscale level to be corrected may be specified in consideration of the degree of the luminance abnormality.

In the correction data generating device according to an embodiment, the grayscale level specification portion specifies the correction target grayscale level based on the grayscale level of an image corresponding to a captured image having a maximum absolute value of the grayscale correction amount calculated by the calculation portion.

The grayscale level specification portion specifies the correction target grayscale level based on the grayscale level of an image corresponding to a captured image having a maximum absolute value of the grayscale correction amount calculated by the calculation portion. Namely, the grayscale level specification portion specifies, as the correction target grayscale level, the grayscale level having a maximum absolute value of the grayscale correction amount Gn required for the correction. With such an arrangement, even in the case where there is a pixel at which the luminance abnormality is large at an arbitrary grayscale level, the grayscale level to be corrected may be easily specified.

In the correction data generating device according to an embodiment, the grayscale level specification portion specifies the correction target grayscale level based on two adjacent grayscale levels of two images corresponding to two captured images for which the sum of two grayscale correction amounts calculated by the calculation portion is minimum.

The grayscale level specification portion specifies the correction target grayscale level based on two adjacent grayscale levels of two images corresponding to two captured images for which the sum of two grayscale correction amounts calculated by the calculation portion is minimum. A case where the sum of the two grayscale correction amounts is minimum may be, for example, a case where one of the grayscale correction amounts is of a negative value and the other grayscale correction amount is of a positive value. It is further preferred that one of the grayscale correction amounts is of a negative value and the other grayscale correction amount is of a positive value that is generally equal to an absolute value of the one grayscale correction amount.

Where the two correction target grayscale levels are N1 and N2, the sum of the grayscale correction amounts at the correction target grayscale levels N1 and N2 is minimum. Therefore, in the case where the grayscale correction amount is interpolated between the correction target grayscale levels N1 and N2, the error in the correction amount may be decreased, and the correction may be performed such that the luminance abnormality is removed even at the grayscale levels as the interpolation targets.

In the correction data generating device according to an embodiment, the display controller performs control so as to display an image obtained by changing the grayscale level by the predetermined grayscale level from the correction target grayscale level specified by the specification portion. The correction data generating device includes a luminance difference determination portion determining whether or not the luminance difference between the luminance value of a captured image obtained by the image capturing performed by the image capturing portion and the predetermined luminance value Ln corresponding to the correction target grayscale level is within a predetermined threshold value. In the case where the luminance difference determination portion determines that the luminance difference is within the predetermined threshold value, the generation portion generates correction data based on the grayscale level changed from the correction target grayscale level.

The display controller performs control so as to display an image obtained by changing the grayscale level by a predetermined grayscale level number from the correction target grayscale level specified by the grayscale level specification portion. The correction target grayscale level is represented by Nr, and the predetermined grayscale level number is represented by ΔN. ΔN may be 1, or another numerical value of 2, 3 or the like. The display controller displays, for example, an image of the grayscale level (Nr−1) or (Nr+1).

The luminance difference determination portion determines whether or not the luminance difference between the luminance value of a captured mage obtained by the image capturing performed by the image capturing portion and the predetermined luminance value corresponding to the correction target grayscale level is within the predetermined threshold value. For example, the grayscale correction amount at the correction target grayscale level Nr is represented by Gnr, and the luminance difference between the luminance value obtained by correcting the grayscale level by the grayscale correction amount Gnr and the predetermined luminance value Ln is represented by ΔL. The luminance difference ΔL is caused by the correction amount being excessive or insufficient when the grayscale level is corrected at the correction target grayscale level Nr. In the case where the luminance difference between the luminance value of a pixel in a captured image obtained by capturing an image of the grayscale level (Nr−ΔN) and the predetermined luminance value Ln is within the predetermined threshold value, this indicates that the luminance value is decreased by approximately ΔL by changing the grayscale level by ΔN from Nr. In this manner, the luminance non-uniformity is removed.

In the case where the luminance difference determination portion determines that the luminance difference is within the predetermined threshold value, the generation portion generates correction data based on the grayscale level changed from the correction target grayscale level. For example, the grayscale correction amount at the correction target grayscale level Nr is represented by Gnr. In the case where the luminance difference between the luminance value of the pixel in the captured image obtained by capturing the image of the grayscale level (Nr−ΔN) and the predetermined luminance value Ln is within the predetermined threshold value, the grayscale level correction amount at the correction target grayscale level Nr may be (Gnr+ΔN). With such an arrangement, the luminance non-uniformity can be corrected accurately (precisely).

In the correction data generating device according to an embodiment, in the case where the luminance difference determination portion determines that the luminance difference is not within the predetermined threshold value, the display controller performs control so as to display an image obtained by further changing the grayscale level by the predetermined grayscale level number, and the process performed by the luminance difference determination portion is repeated.

In the case where the luminance difference determination portion determines that the luminance difference is not within the predetermined threshold value, the display controller performs control so as to display an image obtained by further changing the grayscale level by the predetermined grayscale level number, and the process performed by the luminance difference determination portion is repeated. For example, the grayscale correction amount at the correction target grayscale level Nr is represented by Gnr. In the case where the luminance difference between the luminance value of the pixel in the captured image obtained by capturing the image of the grayscale level (Nr−ΔN) and the predetermined luminance value Ln is not within the predetermined threshold value, the display controller displays, for example, an image of the grayscale level (Nr−2×ΔN). In the case where the luminance value of the pixel in a captured image obtained by capturing the image of the grayscale level (Nr−2×ΔN) and the predetermined luminance value Ln is within the predetermined threshold value, the grayscale correction amount at the correction target grayscale level Nr may be (Gnr+2×ΔN). With such an arrangement, the luminance non-uniformity can be corrected accurately (precisely).

The correction data generating device according to an embodiment includes a region specification portion that, in the case where the luminance difference determination portion determines that the luminance difference between the luminance value of the captured image and the predetermined luminance value is not within the predetermined threshold value, specifies a luminance-abnormal region formed of a pixel(s) having the luminance value. The display controller performs control so as to display an image obtained by changing the grayscale level of the region specified by the region specification portion by the predetermined grayscale level number.

In the case where the luminance difference determination portion determines that the luminance difference between the luminance value of the captured image and the predetermined luminance value is not within the predetermined threshold value, the region specification portion specifies a luminance-abnormal region formed of a pixel(s) having such a luminance value. The display controller performs control so as to display an image obtained by changing the grayscale level of the region specified by the region specification portion by the predetermined grayscale level number. With such an arrangement, it is merely needed to change the grayscale level of the region in which the luminance abnormality is occurring (luminance-abnormal region). Thus, the process is simplified.

The correction data generating method according to another embodiment of the present invention may include the following steps.

Data on images (solid images) in which all the pixels on the display panel exhibit a plurality of grayscale levels is prepared. The plurality of grayscale levels do not need to be all the grayscale levels, and may be any number of grayscale levels arbitrarily selected with some grayscale levels being deleted. The images may be converted into an arbitrary data format.

The correction data is created by the above-described method by use of the prepared image data.

In the case where, for example, the image data is on all the grayscale levels (black may not be included), the grayscale level vs. luminance characteristic of all the abnormal pixels is made known. Therefore, the grayscale level correction amount by which the luminance of each of the abnormal pixels is corrected to the luminance of a normal pixel may be directly found.

The above-described image data may be used to specify a region on the display panel that includes the abnormal pixels to be corrected and the grayscale levels to be corrected.

The image data may be generated as follows. Image data with grayscale levels with a roughly set interval is once generated, and a region on the display panel that includes the abnormal pixels to be corrected and the grayscale levels (range) to be corrected are selected based on the rough image data. Then, regarding the selected region or grayscale level (range) or regarding a region or a grayscale level range including the selected region or grayscale level (range), image data is generated at finely set grayscale levels (e.g., at every grayscale level). In this manner, the correction data may be generated.

This application claims priority of Japanese Patent Application No. 2013-172646, filed on Sep. 14, 2018, the entire contents of which are hereby incorporated by reference.

What is claimed is:

1. A correction data generating device generating correction data for correcting input grayscale level vs. luminance characteristics of a plurality of pixels included in a display region of a display panel, the correction data generating device comprising:

a display controller supplying each of the plurality of pixels with display signal voltages corresponding to two or more grayscale levels;

an acquisition circuit acquiring two or more luminances of each of the plurality of pixels supplied with the display signal voltages respectively corresponding to the two or more grayscale levels;

a specification circuit specifying, among the plurality of pixels, at least one abnormal pixel, the input grayscale level vs. luminance characteristic of which needs to be corrected and also specifying at least one correction target grayscale level including a grayscale level that needs to be corrected, based on the two or more luminances of each of the plurality of pixels acquired by the acquisition circuit; and a generation circuit generating correction data based on the at least one abnormal pixel and the at least one correction target grayscale level specified by the specification circuit.

2. The correction data generating device of claim 1, wherein the two or more grayscale levels include all of grayscale levels except for a lowest grayscale level among grayscale levels of the input grayscale level vs. luminance characteristics of the plurality of pixels.

3. The correction data generating device of claim 1, wherein the two or more grayscale levels include three or more grayscale levels that are every predetermined number of grayscale levels.

4. The correction data generating device of claim 1, wherein upon receipt of the at least one correction target grayscale level specified by the specification circuit, the display controller further supplies each of the plurality of pixels with display signal voltages corresponding to two or more grayscale levels including the at least one correction target grayscale level.

5. The correction data generating device of claim 1, wherein the two or more grayscale levels include three or more grayscale levels that are every predetermined first number of grayscale levels, and wherein upon receipt of the at least one correction target grayscale level specified by the specification circuit, the display controller further supplies each of the plurality of pixels with display signal voltages corresponding to grayscale levels including three or more grayscale levels that include the at least one correction target grayscale level and that are every predetermined second number of grayscale levels, the predetermined second number being smaller than the predetermined first number.

6. The correction data generating device of claim 1, wherein the specification circuit further includes a luminance shift evaluation circuit evaluating a shift from a luminance on a predetermined input grayscale level vs. luminance characteristic, regarding each of the two or more luminances, acquired by the acquisition circuit, of each of the plurality of pixels.

7. The correction data generating device of claim 6, wherein the specification circuit specifies the at least one abnormal pixel and the at least one correction target grayscale level based on a grayscale level and a pixel having a luminance having a maximum of the shift evaluated by the luminance shift evaluation circuit.

8. A non-transitory computer-readable storage medium storing a program causing a computer to generate correction data for correcting input grayscale level vs. luminance characteristics of a plurality of pixels included in a display region of a display panel, the program causing the computer to execute:

a process of supplying each of the plurality of pixels with display signal voltages corresponding to two or more grayscale levels;

a process of acquiring two or more luminances of each of the plurality of pixels supplied with the display signal voltages respectively corresponding to the two or more grayscale levels;

a process of specifying, among the plurality of pixels, at least one abnormal pixel, the input grayscale level vs. luminance characteristic of which needs to be corrected and also specifying at least one correction target grayscale level including a grayscale level that needs to be corrected, based on the two or more luminances of each of the plurality of pixels; and a process of generating correction data based on the at least one abnormal pixel and the at least one correction target grayscale level.

9. A correction data generating method for generating correction data for correcting input grayscale level vs. luminance characteristics of a plurality of pixels included in a display region of a display panel, the correction data generating method comprising:

step (a) of supplying each of the plurality of pixels with display signal voltages corresponding to two or more grayscale levels;

step (b) of acquiring two or more luminances of each of the plurality of pixels supplied with the display signal voltages respectively corresponding to the two or more grayscale levels;

step (c) of specifying, among the plurality of pixels, at least one abnormal pixel, the input grayscale level vs. luminance characteristic of which needs to be corrected and also specifying at least one correction target grayscale level including a grayscale level that needs to be corrected, based on the two or more luminances, acquired in the step (b), of each of the plurality of pixels; and step (d) of generating correction data based on the at least one abnormal pixel and the at least one correction target grayscale level specified in the step (c).

10. The correction data generating method of claim 9, wherein the two or more grayscale levels include all of grayscale levels except for a lowest grayscale level among grayscale levels of the input grayscale level vs. luminance characteristics of the plurality of pixels.

11. The correction data generating method of claim 9, wherein the two or more grayscale levels include three or more grayscale levels that are every predetermined number of grayscale levels.

12. The correction data generating method of claim 9, further comprising:

after the step (c), step (a1) of supplying each of the plurality of pixels with display signal voltages corresponding to two or more grayscale levels including the at least one correction target grayscale level, and step (b1) of acquiring two or more luminances of each of the plurality of pixels supplied with the display signal voltages in the step (a1).

13. The correction data generating method of claim 12, wherein the two or more grayscale levels in the step (a) include three or more grayscale levels that are every predetermined number of grayscale levels, and wherein the two or more grayscale levels in the step (a1) include three or more grayscale levels that are every predetermined number of grayscale levels smaller than the predetermined number of grayscale levels in the step (a).

14. The correction data generating method of claim 9, wherein the step (c) includes step (c1) of evaluating a shift from a luminance on a predetermined input grayscale level vs. luminance characteristic, regarding each of the two or more luminances, acquired in the step (b), of each of the plurality of pixels.

15. The correction data generating method of claim 14, wherein the step (c) includes a step of specifying the at least one abnormal pixel and the at least one correction target grayscale level based on a grayscale level and a pixel having a luminance having a maximum of the shift evaluated in the step (c1).

16. A method for producing a display panel, the method comprising a step of creating, based on the correction data generated by the method of claim 9, a lookup table based on which an input grayscale level vs. luminance characteristic is determined and writing the lookup table on a storage device included in the display panel.

* * * * *